United States Patent [19]

Iten

[11] 4,241,500

[45] Dec. 30, 1980

[54] RAZOR WITH ADJUSTABLE BLADE POSITIONING

[75] Inventor: Clemens A. Iten, Staunton, Va.

[73] Assignee: American Safety Razor Company, Verona, Va.

[21] Appl. No.: 56,370

[22] Filed: Jul. 10, 1979

[51] Int. Cl.[3] ..... B26B 21/24

[52] U.S. Cl. ..... 30/40; 30/63

[58] Field of Search ..... 30/40, 40.1, 54, 57, 30/79, 63

[56] References Cited

U.S. PATENT DOCUMENTS

| | | | |
|---|---|---|---|
| 3,137,940 | 6/1964 | Curci | 30/40 |
| 3,203,093 | 8/1965 | Kuhnl | 30/63 |
| 3,224,090 | 12/1965 | Kruger | 30/63 |
| 3,555,681 | 1/1971 | Kuhnl | 30/40.1 |
| 3,619,900 | 11/1971 | Matsuura | 30/40 |
| 3,648,365 | 3/1972 | Iten et al. | 30/40 |
| 3,909,941 | 10/1975 | Bowman | 30/57 |

*Primary Examiner*—Jimmy C. Peters

*Attorney, Agent, or Firm*—Wender, Murase & White

[57] ABSTRACT

A safety razor incorporates an apparatus for substantially vertical displacement of a blade carrier and the shaving edge carried thereby with respect to a skin guard. The blade carrier includes a circular hub retained by a circular receiving portion of a cover member used in the razor. A circular interfacing device, between the hub and the receiving portion, incorporates two eccentric segments. A first segment receives the hub, and the second segment is engaged by the receiving portion of the cover. Rotation of the interfacing device in the cover provides displacement of the blade in accordance with movement of the centers of the two segments of the device. Such displacement specifically causes movement of the razor blade with respect to the skin guard formed in the cover, and is used to provide a height adjustment for the blade.

21 Claims, 11 Drawing Figures

RAZOR WITH ADJUSTABLE BLADE POSITIONING

BACKGROUND OF THE INVENTION

1. Field of the Invention

The present invention relates to means for adjusting shaving geometry, particularly to means for displacing a razor blade with respect to a skin guard. More specifically, the invention relates to the use of eccentrically related circular structures for such adjustment of shaving geometry.

2. Prior Art

The present invention is useful in providing an adjustable shaving geometry in razors of the type disclosed in Iten et al. U.S. Pat. No. 3,648,365, assigned to the assignee of the present invention and known as the "FLICKER" ® razor. While U.S. Pat. No. 3,648,365 discloses an environment for the present invention and is incorporated herein by reference, no suggestion is provided therein either of the broad concept of adjustability of shaving geometry or, more particularly, of the present approach utilized for such adjustment.

Razors having adjustable shaving geometries are known, but none of the prior art discloses an adjusting mechanism at all similar to the present invention.

Ayotte, U.S. Pat. No. 3,015,158, rocks a clamping plate and blade on a crowned fulcrum ridge by means of a blade adjusting screw. Nissen et al. U.S. Pat. No. 3,871,077 moves a guard member in order to cause movement of a blade cutting edge, thereby to adjust the shaving geometry. Neither of these references, however, discloses the present structure for vertical blade motion with respect to a skin guard. Other references are known which disclose the movement of adjustable levers and guards, but not of shaving blades. For example, Perry U.S. Pat. No. 3,783,507 shows a camming member in FIG. 20. The camming member has a groove 56, with a center which is offset and forwardly displaced from the center of its pivot axis, to move a guard. Nissen U.S. Pat. Nos. 3,375,578 and 3,587,174 show cams in FIGS. 21 and 33 operating with a guide plate camming lever having two cam follower surfaces, the lever having two identical sets of arcuate segments with differing radii. The apparatus is used to move an adjusting lever as disclosed at column 8 in '578, for example. Kuhnl U.S. Pat. No. 3,555,681 utilizes rotatable cams or bars for moving a magazine cover with respect to the body, thus moving a guard with respect to the blade edge. Narizzano U.S. Pat. No. 2,958,128 incorporates a cam to provide lateral motion of a guard.

Other prior art references include Schick U.S. Pat. No. 1,584,811, Smith et al. U.S. Pat. No. 2,043,124, Jones et al. U.S. Pat. No. 2,587,625, Perry U.S. Pat. Nos. 3,364,570 and 3,364,571, and Braginetz U.S. Pat. No. 3,619,901. Any adjustability disclosed in these references is even further removed from that hereinabove described, and pertains to the utilization of cams, for example, to adjust guard positioning.

In short, none of the references provides a simply implemented asjusting means for displacing a blade with respect to a skin guard, or for displacing a blade carrier having a plurality of blades mounted thereon with respect to a cover member having a skin guard thereon. Moreover, none of the known adjusting means is suitable to a circular razor structure such as disclosed in Iten et al. U.S. Pat. No. 3,648,365.

SUMMARY AND OBJECTS OF THE INVENTION

The present invention provides a means for adjusting the shaving geometry of razors having circular portions therein. Specifically, adjusting means are disclosed for FLICKER type razors.

The adjusting means particularly utilizes the rotatable relationship between a central hub portion of a blade carrier, supporting a plurality of blades, and the razor cover.

An eccentric relationship between the hub and a circular receiving portion in the cover is introduced by the adjusting means.

The adjusting means particularly includes a pair of eccentric circular portions, one engaging the circular hub of the carrier, the other engaging the circular receiving portion of the cover. Rotation of the adjusting means within the cover causes displacement of the center of the hub and accordingly of the entire carrier portion. The resulting motion causes the blade to be displaced with respect to the cover. Inasmuch as the cover includes the skin guard, such displacement accordingly effects an adjustment in the razor shaving geometry.

It is accordingly a primary object of the present invention to overcome the deficiencies of the prior art and to provide a simple means for adjusting blade positioning and associated shaving geometry. The disclosed means is particularly usable in razors having a blade carrier with a circular portion received in a second circular portion in a cover member and usable to effect rotation of the blade carrier.

These and other objects, features, and advantages of the present invention will become more readily apparent from the following specification and appended claims, when considered in conjunction with the attached drawings.

DETAILED DESCRIPTION OF THE PREFERRED EMBODIMENT

Figure 1:
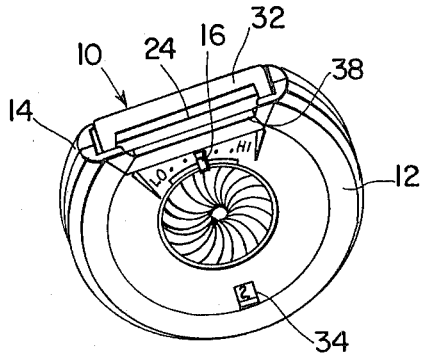
FIG. 1 is a perspective view of one form of an assembled adjustable razor in accordance with the present invention.
Figure 2:
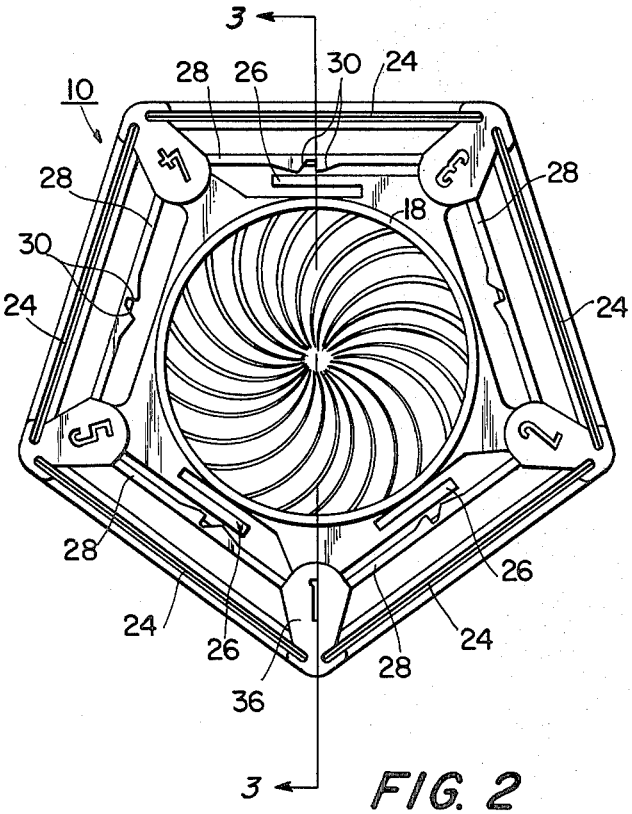
FIG. 2 is a front view of the blade carrier used in the razor of FIG. 1.
Figure 3:
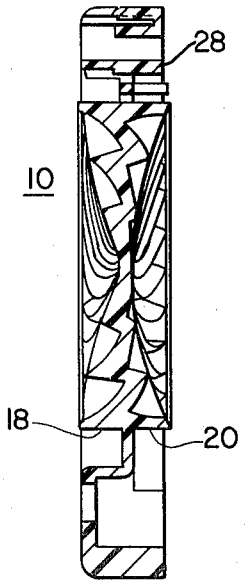
FIG. 3 is a sectional view of the blade carrier taken at line 3—3 in FIG. 2.
Figure 4:
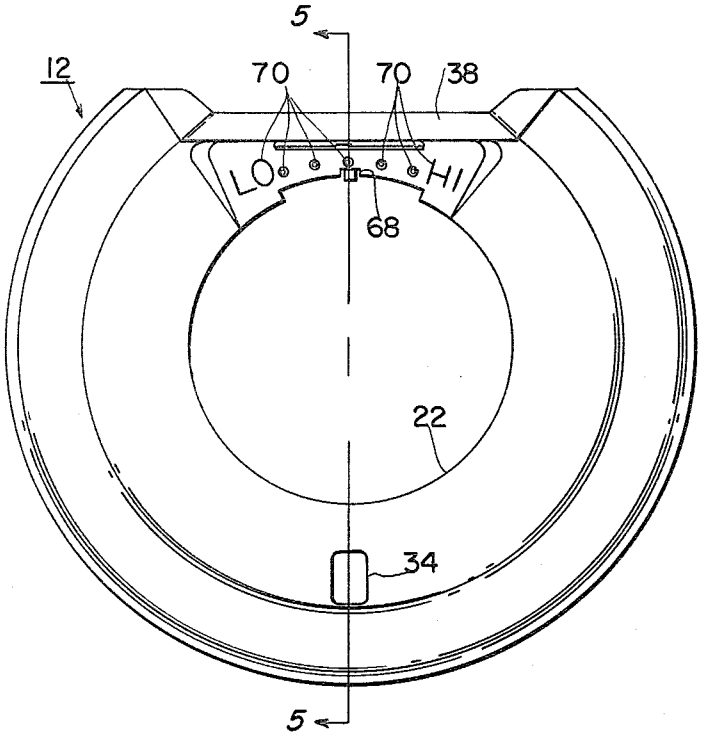
FIG. 4 is a front view of the front cover disc of the razor shown in FIG. 1.

Referring first to the invention as shown in FIG. 1, the adjustable razor is comprised of four major elements: a disc-shaped blade holder, or carrier, 10; a front cover disc 12; a rear cover disc 14; and a substantially circular adjusting means 16. These elements are preferably formed of a suitable plastic material, but one or more could be composed of metal or other materials. The blade carrier 10 is shown in greater detail in FIGS. 2 and 3, and includes front and rear cylindrical extensions forming central hubs 18 and 20, respectively, on the front and rear faces of the carrier. Hubs 18 and 20 generally extend into circular openings in front and rear cover discs 12 and 14. An opening 22 is shown at FIG. 4 in front cover disc 12. While the present embodiment shows a rear central hub 20 in carrier 10, the present invention does not require use of two hubs. That is, a single central hub, located at either the front or the rear face of the carrier, cooperates with adjusting means 16 in a circular opening in either cover disc. The carrier 10 supports a series of blades 24 at its periphery, extending generally in end-to-end relationship to each other. The number of blades, and correspondingly the shape of the blade carrier, may vary in accordance with design considerations. In FIGS. 1 through 3 the carrier is shown as supporting five blades and accordingly has a generally pentagonal shape in outline. Other carrier shapes result from the use of different numbers of blades.

The opening 22 in front cover 12 generally provides support for carrier 10. Support for the rear portion of carrier 10 may be provided by a corresponding relationship between an opening (not shown) in rear cover 14 and rear hub 20. Additional support is provided by fingers 26 in carrier 10 which elastically engage rear cover 14 in the manner described in the aforementioned U.S. Pat. No. 3,648,365. As further disclosed therein, carrier 10 includes a series of flanges 28 from which depend pairs of cam lugs 30. The cam lugs, forming notches therebetween, provide a detent means for positioning the blade carrier such that a particular one of the series of blades is exposed at a shaving area indicated at 32 in FIG. 1. A window 34 in front cover 12 is adapted to display the respective blade numbers, such as indicated at 36 for the numeral 1.

Figure 5:
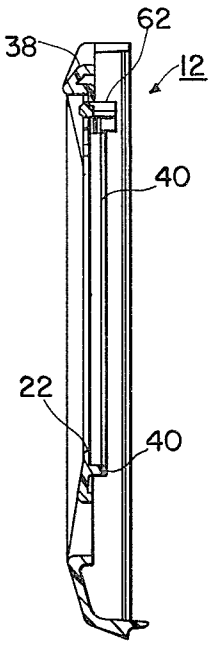
FIG. 5 is a sectional view of the front cover taken at line 5—5 in FIG. 4.

Front cover disc 12 incorporates a soap bar, or skin guard 38, formed of a protruding portion as shown in FIGS. 1, 4 and 5.

Figure 11:
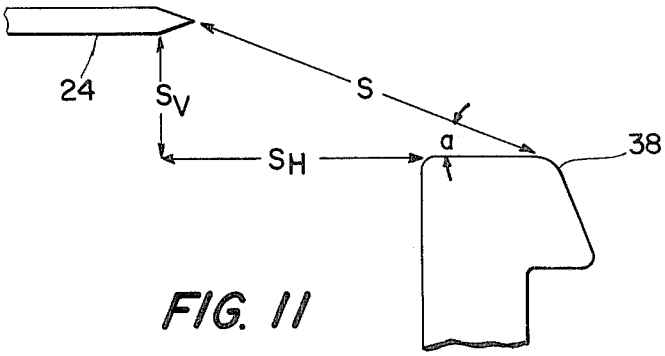
FIG. 11 shows the shaving geometry of the razor.

The shaving geometry formed at shaving area 32 by the relative positioning of blade 24 and skin guard 38 determines the closeness of a shave and the relative comfort experienced by a user in shaving with the present apparatus. One element of the shaving geometry is known as the shaving span, determined by the distance between the sharpened edge of the blade and the skin guard. As shown in FIG. 11, the span S between blade 24 and skin guard 38 includes a vertical component $S_V$ and a horizontal component $S_H$. $S_V$ is substantially perpendicular to the plane of the blade, and $S_H$ substantially parallel thereto. The ratio of $S_V$ to $S_H$ forms the tangent of the shave angle a. Comfort and cutting efficiency of a particular shave may be varied by altering the shaving geometry, whether by changing the shave angle, the shaving span, or one of the components of the shaving span. Such alteration is ordinarily achieved by displacement of a movable skin guard. The present invention provides an adjusting means, shown in FIGS. 7 through 9, which displaces the blade carrier, or holder 10, and thus shaving blade 24, with respect to skin guard 38. An adjustment is particularly made in the vertical component of the shaving span. Alternatively, the adjustment may be viewed as an adjustment in the shave angle.

Figure 6:
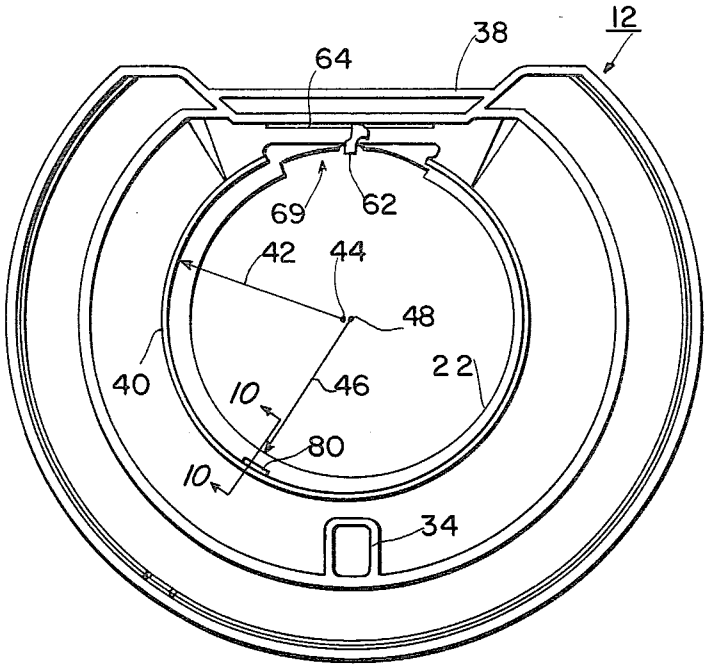
FIG. 6 is a rear view of the front cover disc.

Referring now to FIGS. 4, 5 and 6, the front cover of the present invention includes an annular rib, or flange 40. The rib is substantially circular in shape, and is described by a radius 42 and a center 44. It is particularly to be noted that, while circular opening 22 is described by a radius 46 and a center 48, the center 48 of opening 22 is displaced horizontally with respect to center 44. The eccentric relationship between the rib 40 and the remainder of front cover 12, including opening 22, cooperates with adjusting means 16 as hereinafter described.

Figure 7:
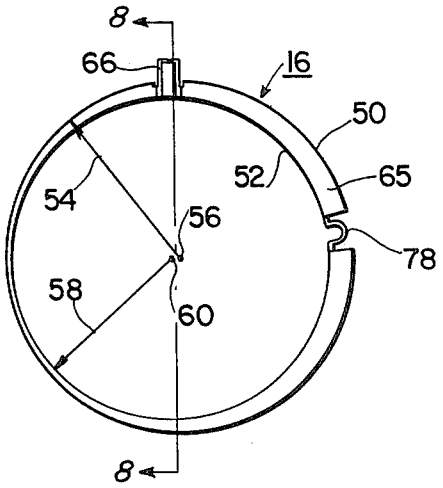
FIG. 7 is a front view of the adjusting means of the present invention.

The adjusting means of the present invention is shown in FIG. 7 as including an outer circular portion 50 and an inner circular portion 52. Outer portion 50 is described by radius 54 and center 56. Inner circular portion 52 is described by radius 58 and center 60. Circular portions 50 and 52 are eccentric. That is, centers 56 and 58 are displaced from one another. Radius 54 is chosen to enable outer circular portion 50 of adjusting means 16 to fit within rib 40. Radius 58 is selected to permit central hub 18 to fit within inner circular portion 52. This arrangement assures that, when assembled with adjusting means 16 mounted on central hub 18 and within rib 40, the present adjustable razor provides a fixed relationship between center 56 of outer circular portion 50, rib 40, and front cover 12. Rotation of adjustable means 16 within rib 40 does not alter the location of center 56. The eccentric relationship between outer and inner portions 50 and 52 accordingly causes the displacement of center 60 with respect to the rib 40, and consequently with respect to the entire front cover 12. Inasmuch as center 60 is fixed with respect to hub 18, and consequently with respect to the blade carrier 10 and blades 24 mounted thereon, displacement of center 60 provides a similar displacement of blade 24 with respect to front cover 12 and skin guard 38 thereof. Selection of a neutral adjustment wherein centers 60 and 56 are displaced horizontally only permits center 60 (and blades 24) to move vertically upward in response to a clockwise rotation of adjusting means 16, and to move vertically downward in response to a counterclockwise rotation of adjusting means 16.

Inasmuch as the present invention provides for motion of center 60 in an arc about center 56, rather than for strictly vertical displacement, blade 24 accordingly obtains varying degrees of inclination to the skin guard 38 as a result of a change in the adjustment. To minimize this effect the maximal variation in adjustment is split between upward and downward adjustment. That is, a nominal adjustment is selected with the line connecting centers 56 and 60 parallel to the skin guard 38. Centers 44 and 48 are similarly displaced along a line parallel to skin guard 38 to assure that at the nominal adjustment the blade and skin guard will be parallel. Maximal inclination of the blade with respect to the skin guard is thus halved, but occurs (in opposite directions) in both highest and lowest adjustments.

As previously described, both in the present specification and that of U.S. Pat. No. 3,648,365, cam lugs 30 provide detent means in cooperation with a fixed lug 62 on front cover 12, as shown in FIG. 6. Lug 62 engages the notch formed between lugs 30 to retain blade 24 in a fixed position. Upward motion of outer circular portion 50 of adjusting means 16 is performing its function thus transmits stresses to front cover 12 by fixed lug 62. A relief slot 64 is accordingly formed in the front cover to permit lug 62 to respond to an upward movement of the shaving span without binding the adjusting means 16. Lug 62 is rearwardly displaced from the opening 22 in order to engage a lip 65 on adjusting means 16, thereby securing placement thereof in front cover 12.

Figure 10:
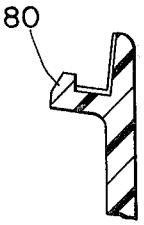
FIG. 10 is a sectional view of a detail of the front cover taken at line 10—10 of FIG. 6.

In order further to facilitate assembly of the disclosed adjustable razor, a ring holding lug 80 may be provided on flange 40, shown in FIGS. 6 and 10. Lug 80, similarly to lug 62, engages lip 65 of the adjusting means 16.

A manual rotating means 66 is provided on adjusting means 16 to enable manual rotation thereof. Rotating means 66 protrudes through an opening 68 shown in FIG. 4 and is available for manual grasping from the front of the razor. Opening 68 includes an arc portion 69, appropriately situated to permit non-binding movement of means 66 as it is rotated to provide the desired blade adjustment. the manual rotating means is further used to provide an index of adjustment height, in cooperation with a plurality of indicia 70 formed on front cover 12. Indicia 70 comprise raised points formed on the cover. Rotating means 66 includes a slot 72 for engaging the indica 70, thus providing a detent means for maintaining a particular selected shaving geometry adjustment.

Figure 8:
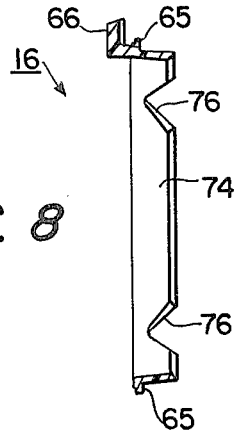
FIG. 8 is a sectional view of the adjusting means taken at line 8—8 in FIG. 7.
Figure 9:
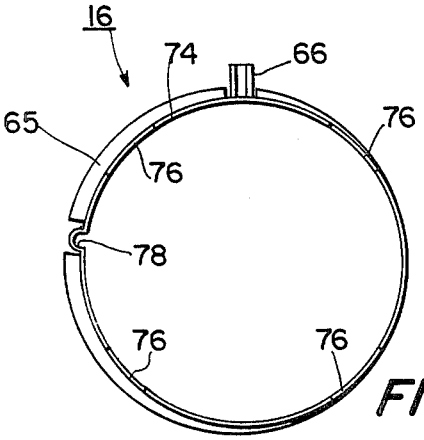
FIG. 9 is a rear view of the adjusting means of the present invention.

To assure effective adjustment capability, the radius 58 of inner circular portion 52 of the adjusting means is chosen to provide a snug fit with the outer radius of central hub 18. The snug fit is desired to assure constancy of adjustment of the shaving geometry. Referring to FIGS. 8 and 9, the adjusting means is seen to incorporate therein a substantially cylindrical portion 74 mounted on lip 65. As seen in FIG. 8, the cylindrical portion may in fact be tapered and be represented by a frustum of a cone rather than a right cylindrical surface. The decreasing inner diameter of portion 74 can assure a frictional fit with the outer diameter of hub 18. For mounting purposes, however, cylindrical portion 74 is advantageously provided with a plurality of circumferential V slots 76 to provide torsional flexibility for ease of assembly and rotation. The ring skirt is thus effectively provided with spring segments acting on a hub to enhance constancy of adjustment, yet permitting ease in assembly and rotation.

While a closed ring-like structure is utilized for the circular adjusting means 16, it is apparent that a split ring may be advantageously utilized. A split ring provides additional circumferential flexure and provides advantages similar to those hereinabove described for the torsional flex provided by the circumferential V slots. However, the components of a split ring might introduce a binding problem. The present invention accordingly provides the advantages of a split ring in a continuous ring structure by utilizing a U-shaped connector 78. While a continuous ring requires tight tolerance limits in order to provide the snug fit required for proper operation of the present adjustment device, utilization of connector 78 permits use of tighter radii in adjusting means 16, yet provides split ring flexibility to avoid binding between blade carrier 10 and the adjusting means.

As disclosed in U.S. Pat. No. 3,648,365, in an alternative embodiment the blade carrier may comprise the rear cover of the razor. The above-described eccentric arrangement may still be used in such an alternative embodiment. Conceivably, however, the adjusting means may comprise a ring, with eccentric circular portions, which fits between the outer circular portions of the front cover and the combined rear cover and blade carrier. That is, the ring may accept one of the outer circumferences of the front and back covers (rather than a central hub thereof) and may itself be accepted by the other outer circumference. Further, although the foregoing description discloses an adjusting means cooperating with the blade holder and the front cover, the invention may be practiced with the adjusting means cooperating with the rear cover instead. Still further, the preceding specification of the preferred embodiment discloses that the adjusting means is an intermediate apparatus between the blade holder and one of the covers, specifically illustrating the blade holder as having the smaller diameter circular component received within the adjusting means which is in turn received within a larger diameter circular component on the cover. As would be obvious to those skilled in the art, the invention may similarly be practiced with an adjusting means rotating within a circular rib provided on the blade holder, and about a circular component provided in the cover. Thus the radius of the circular component of the blade carrier may in fact be greater than the radius of the circular component of the cover. It is similarly apparent that the invention may be practiced in a razor wherein the blade is mounted so that the plane of the adjusting means and the plane of the blade have any preselected angular relationship. That is, the two planes need not be substantially perpendicular as in the present embodiment. In the event that a non-perpendicular relationship is provided, it is clear that both the horizontal and vertical components of the shaving span will be affected by an adjustment in accordance with the present invention.

The preceding specification describes, by way of illustration and not of limitation, a preferred embodiment of the invention. Equivalent variations of the described embodiment will occur to those skilled in the art. Such variations, modifications, and equivalents are within the scope of the invention as recited with greater particularity in the following claims, when interpreted to obtain the benefits of all equivalents to which the invention is fairly entitled. What I claim is:

1. In a razor accommodating a blade carrier, said blade carrier having a first substantially circular component and fixedly retaining a blade having a sharpened edge;

said razor having: a support structure for said blade carrier; a second substantially circular component engaging said first substantially circular component; and skin guard means;

said skin guard means disposed in spaced relation with said blade for defining a particular shaving geometry, the improvement comprising:

adjusting means for moving said blade carrier relative to said skin guard means thereby effecting an adjustment in said shaving geometry.

2. A razor in accordance with claim 1 wherein said adjusting means comprises intermediate means for engaging said first and said second substantially circular components, said intermediate means rotating within one and about the other of said first and second substantially circular components.

3. A razor in accordance with claim 2 wherein said intermediate means comprises:

third means comprising a substantially circular portion for rotating within said one of said first and second substantially circular components, and fourth means comprising a substantially circular portion for rotating about said other of said first and second substantially circular components, said third and fourth means having centers of rotations eccentrically disposed with respect to one another.

4. A razor in accordance with claim 3 wherein said intermediate means rotates about said first substantially circular component and within said second substantially circular component, said second substantially circular component having a radius larger than said first substantially circular component.

5. A razor in accordance with claim 3 wherein said razor comprises first indexing means and wherein said intermediate means comprises second indexing means, said first and second indexing means cooperating for providing an indication of said shaving geometry adjustment.

6. A razor in accordance with claim 3 wherein said intermediate means further comprises manually engageable means for effecting rotation thereof.

7. A razor in accordance with claim 1 wherein said shaving geometry is described by a shaving span between said sharpened edge and said skin guard means, said shaving span having a first distance component substantially parallel to the plane of said blade and a second distance component substantially perpendicular to the plane of said blade, said adjusting means comprising means providing a change in said second distance component of said span.

8. A razor in accordance with claim 1 wherein said blade carrier comprises means for retaining a plurality of shaving edges, said blade carrier rotatably mounted within said razor selectively to present a single one of said plurality of shaving edges at, and substantially parallel to, said skin guard means, said first substantially circular component of said blade carrier comprising an annular flange projecting outwardly therefrom, said second substantially circular component comprising an annular rib for receiving said annular flange, said adjusting means comprising first and second annular portions, said first annular portion mounted on said second annular portion for engaging said blade carrier annular flange, said second annular portion engaging said annular rib on said razor, said first and second annular portions on said adjusting means being eccentrically related to one another, said first annular portion and said blade carrier annular flange having centers in substantially fixed relation to one another, said second annular portion and said annular rib having centers in substantially fixed relation to one another, said adjusting means thereby adapted to provide movement of said centers of said first annular means and said blade carrier annular flange with respect to said centers of said second annular portion and said annular rib upon a rotation of said second annular means within said annular rib, whereby a blade shaving edge is moved with respect to said skin guard.

9. A razor in accordance with claim 1 wherein said blade carrier is integrally molded.

10. A razor in accordance with claim 1 wherein said razor support structure comprises an integrally molded component having said second substantially circular component and said skin guard thereon.

11. A razor in accordance with claim 1 wherein said adjusting means is integrally molded.

12. A razor in accordance with claim 11 wherein said adjusting means comprises annular flange means having a substantially cylindrical portion eccentrically mounted on a flat portion having a substantially circular perimeter.

13. A razor in accordance with claim 12 wherein said cylindrical portion comprises means for enhancing torsional flexure characteristics thereof, comprising substantially V-shaped notches.

14. A razor in accordance with claim 12 wherein said adjusting means comprises means for enhancing circumferential flexure characteristics.

15. A razor in accordance with claim 14 wherein said means for enhancing comprises U-shaped connector means.

16. A razor in accordance with claim 12 wherein said cylindrical portion is tapered to providea frustum of a cone for positive engagement of said first substantially circular component.

17. In a razor having the form generally of a flat disc comprising front and rear cover members forming a casing, and a blade holder with an integral hub part projecting through a central opening in one of said cover members, said one cover member having an opening for a blade exposure area for shaving, the improvement comprising:

adjusting means engaging said hub part and rotatable with respect to said central opening, comprising a first substantially circular portion for engaging said hub part and a second substantially circular portion for rotating with respect to said central opening;

said first and second substantially circular portions having centers displaced from one another thereby causing said circular portions to be eccentric with respect to one another.

18. A razor according to claim 17 wherein said holder is substantially disc like in shape, and has mounted at the periphery thereof a series of individual blades, said blade holder being rotatably mounted between said cover members.

19. A razor according to claim 18 wherein said integral hub part projecting through said central opening is exposed for manual engagement to rotate said holder.

20. A razor according to claim 17 wherein said blade exposure area is described by a shaving geometry including a shave angle and a shaving span having vertical and horizontal components, and wherein said adjusting means is mounted on said hub at an angle selected to enable variation of said shave angle by adjustment of one of said components of said shaving span.

21. A razor according to claim 20 wherein said one component is the vertical component, and wherein the horizontal component remains substantially unaltered during said adjustment.

* * * * *